US005231720A

United States Patent [19]

Benoff

[11] Patent Number: 5,231,720

[45] Date of Patent: Aug. 3, 1993

[54] SUPPORT PILLOW

[76] Inventor: Jack Benoff, 1211 Old Jordan Rd., Holland, Pa. 18966

[21] Appl. No.: 966,388

[22] Filed: Oct. 26, 1992

[51] Int. Cl.[5] ..... A47C 9/00

[52] U.S. Cl. ..... 5/644; 5/638; 5/645

[58] Field of Search ..... 5/636, 638, 640, 644, 5/645

[56] References Cited

U.S. PATENT DOCUMENTS

| | | | |
|---|---|---|---|
| 2,822,554 | 2/1958 | Wenzelberger | 5/644 |
| 3,239,854 | 3/1966 | Freedlander | 5/636 |
| 3,242,511 | 3/1966 | Fultz et al. | 5/645 X |
| 4,021,871 | 5/1977 | Wortman | 5/636 |
| 4,501,034 | 2/1985 | Greenawalt | 5/644 |
| 4,528,705 | 7/1985 | Greenawalt | 5/644 |

FOREIGN PATENT DOCUMENTS

| | | | |
|---|---|---|---|
| 211382 | 3/1951 | Australia | 5/636 |

*Primary Examiner*—Michael F. Trettel
*Attorney, Agent, or Firm*—Joseph W. Molasky & Associates

[57] ABSTRACT

A support pillow comprised of a shell having a hollow interior, said interior being equipped with an adjustable expandable bladder which is connected to a gas line including a valve means that extends through said shell. The bladder can be inflated and deflated to provide a support means in which firmness can be varied and comfort maximized to accommodate the user's needs.

6 Claims, 3 Drawing Sheets

FIG. 5
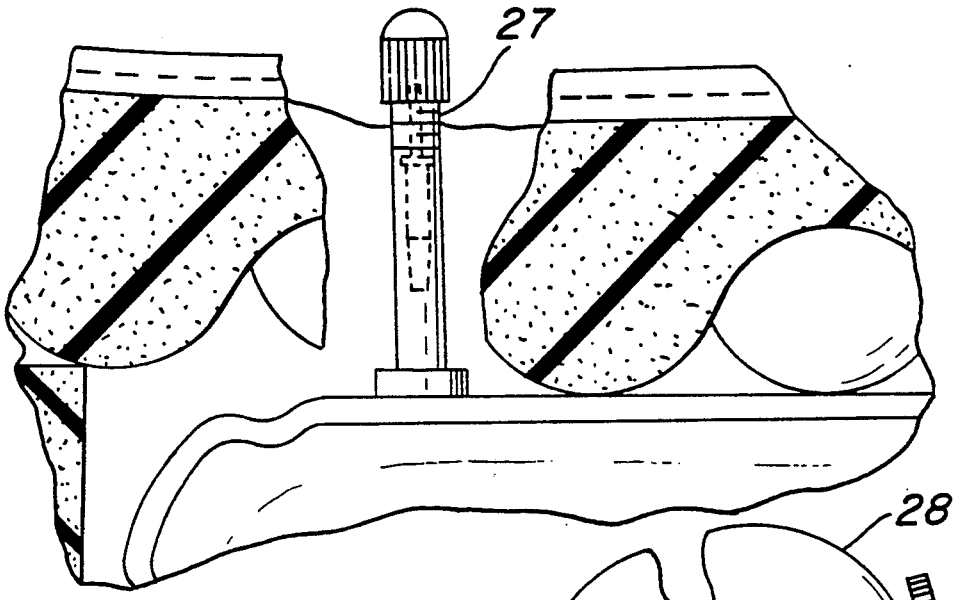
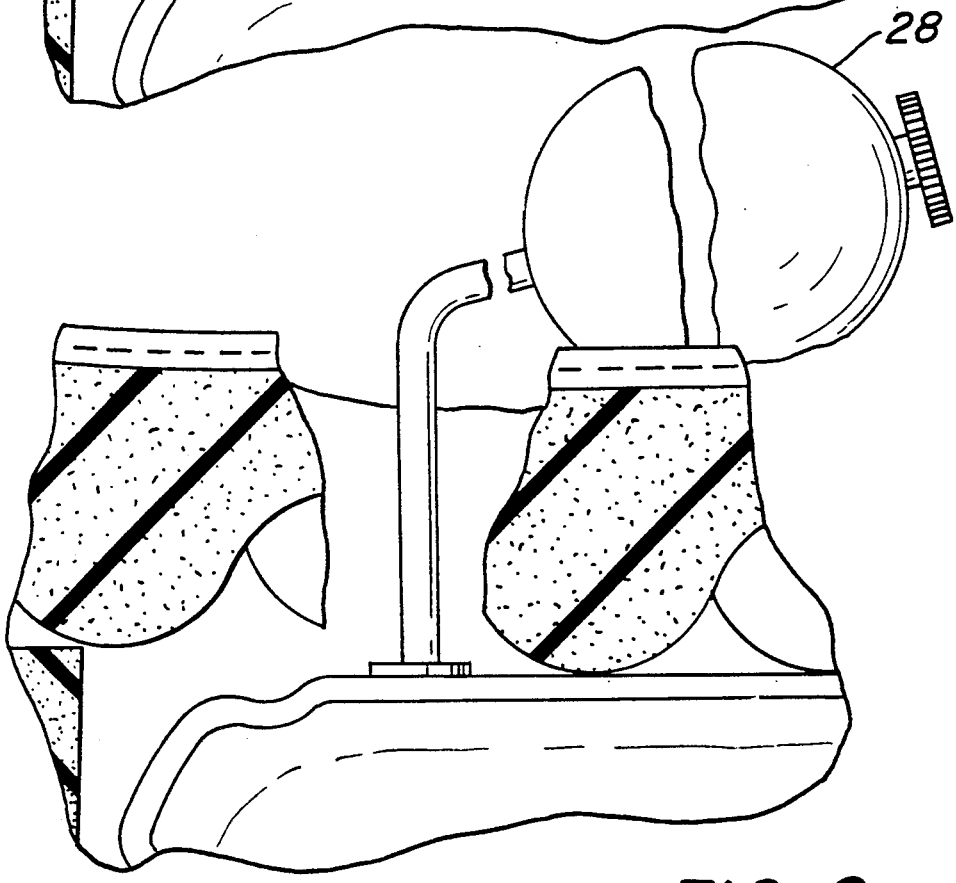
FIG. 6

SUPPORT PILLOW

This invention relates to a supportive pillow. More particularly, this invention relates to a pillow support that is readily adjustable.

BACKGROUND OF THE INVENTION

Most bed pillows are made of poultry down or feathers or a combination of both, and more recently, they have been made of synthetic plastic foam materials of various weights and degrees of firmness. In general, such pillows have a uniform interior density and thus provide a uniform degree of support for the user that is generally fixed at the time of manufacture.

However, for persons who have been injured or are in pain, particularly in the neck area, it is desirable to be able to adjust the firmness of the pillow in different areas so as to maximize comfort.

SUMMARY OF THE INVENTION

I have invented an adjustable support pillow comprised of a shell and interior opening or cavity which contains an inflatable bladder. This bladder is connected to a gas line and a valve that extends to the exterior of the pillow so that inflation and deflation of the bladder can be readily controlled by the user.

BRIEF DESCRIPTION OF THE DRAWINGS

FIG. 5 is a partial cutaway, cross-sectional view illustrating an embodiment of the pillow of the present invention having a bleed-type valve.

FIG. 6 is a partial cutaway, cross-sectional view illustrating an embodiment of the pillow of the present invention having a bulb-type inflation-deflation valve.

DETAILED DESCRIPTION OF THE INVENTION

The support pillow of this invention consists essentially of an external foam shell having an interior cavity which contains an inflatable bladder and this in turn is connected to an external valve means for inflation and deflation purposes. This valve means allows the user to increase or decrease the amount of air in the bladder and, thus control the amount of support or stiffness of the pillow. This is a particularly desirable feature because it allows the user to adapt the pillow to his or her needs and provide support to those body parts which must be elevated as, for example, the head area in order to relieve pressure on the neck while resting.

The support pillow of this invention will now be described with particularity by reference to the Drawings.

Figure 1:
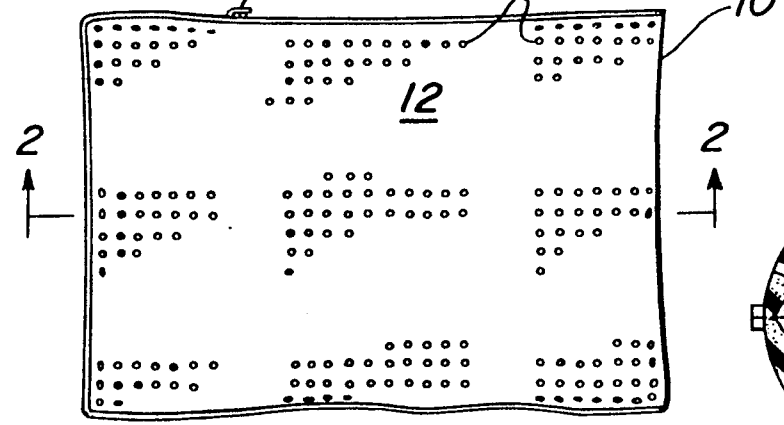
FIG. 1 is a top plan view of a pillow of this invention.

FIG. 1 is a top plan view of the exterior shell 12 of a support pillow 10 of this invention. The support pillow 10 may be constructed from one or more foam sheets fastened or glued together to form a centrally located hollowed-out portion or cavity 26 therewithin. The exterior of the foam shell 12 is preferably characterized by a reticulated pattern of small openings or air holes 14. These holes lead through the exterior shell 12 to the interior cavity 26 and they allow air to be squeezed out upon compression. Conversely, they allow air to reenter when the pillow is decompressed.

Moreover, this feature, that is, the plurality of air hole openings, make it possible for the user to breathe and/or avoid suffocation in the event that the user turns over and lies face-down on the pillow 10.

Figure 2:
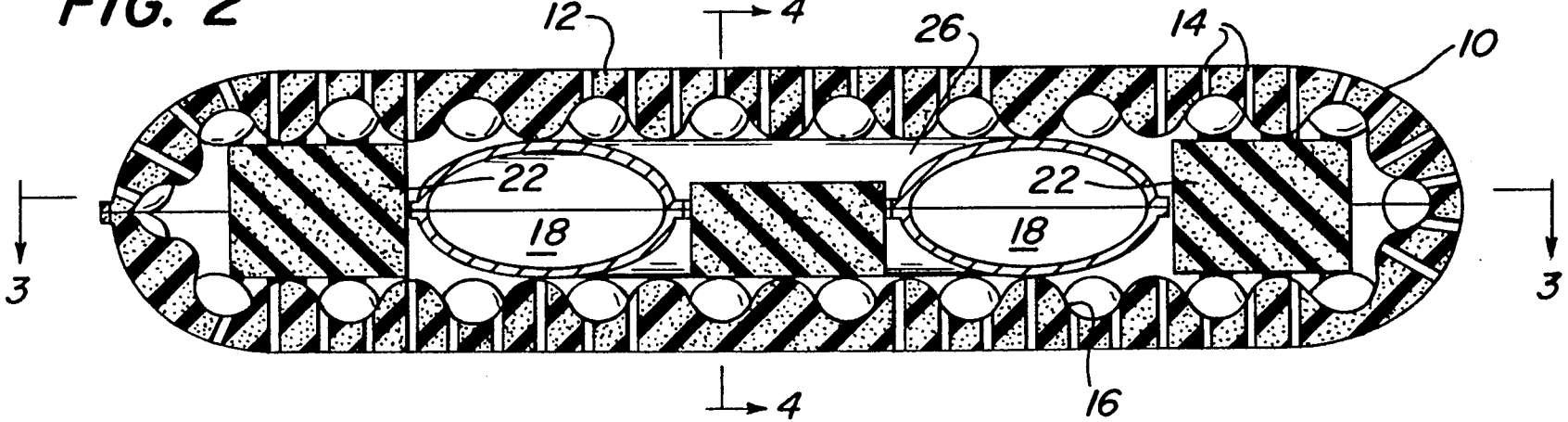
FIG. 2 is a cross sectional taken along lines 2—2 of FIG. 1.

FIG. 2 is a cross sectional view showing the interior design of the pillow 10. The outer wall 15 is characterized by a convoluted interior edge 16 which maximizes comfort and flexibility. Since the edge 16 is somewhat uneven, it does not impart any rigidity to the edge of the pillow 10.

The interior of the pillow 10 contains a U-shaped inflatable bladder 18 having valve means 20 which passes through the exterior shell 12 of the pillow for ready access. The bladder expands and contracts depending upon the amount of air or other gas introduced into the bladder 18 and, therefore, it can be readily adjusted to the desired degree of firmness and elevation by controlling the amount of air or gas entering valve 20.

The bladder 18 is inflated by blowing air or other gas, such as nitrogen, into valve 20 via the connecting gas line 19. Various valve means are well known and these include valves that can be opened or shut by means of a pivotable cap which fit into the gas line 19 or, alternatively, a bleed type valve 27 as shown in FIG. 5. A bulb-type valve 28 as shown in FIG. 6, such as those used on blood pressure sleeves, can also be employed. Other valves, well known to those skilled in the art, can also be substituted therefor.

As illustrated, the valve 20 is shown at the back of the pillow 10, but this placement is not critical and the valve can enter the interior of the pillow 10 at any point that does not interfere with its comfortable use.

Figure 4:
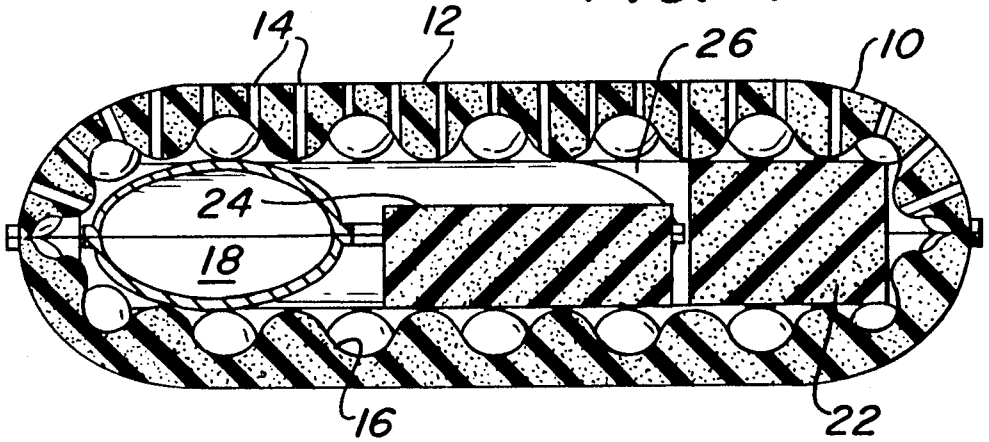
FIG. 4 is a cross sectional view taken along lines 4—4 of FIG. 3.
Figure 3:
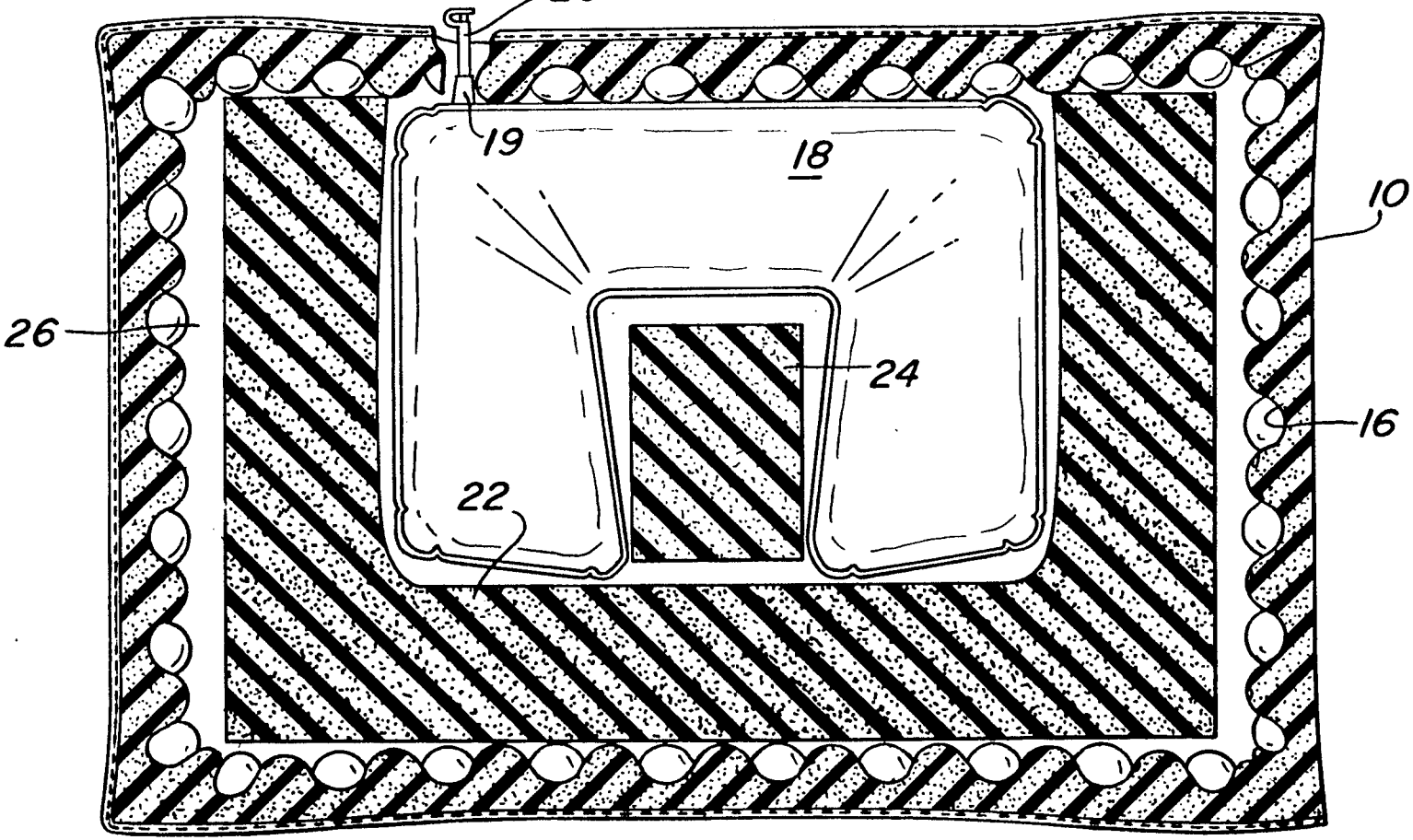
FIG. 3 is a cross sectional view taken along lines 3—3 of FIG. 2.

As shown in FIGS. 2–4, the interior of the pillow 10 may contain additional foam support 22 and 24. The foam support 22 may be in the form of a sheet or molded piece which has been contoured to fit about the bladder 18, or it may consist of foam in shredded form. The foam support 22 serves to maintain the bladder 18 in position near the center of the pillow, and it provides additional support and comfort for the user's head.

Located centrally within the "U" of the bladder 18 and serving an identical purpose is the foam support 24. Preferably this foam support 24 is slightly firmer than the foam support 22 within the "U" and it is constructed in such manner as to provide additional support to the user's neck.

FIG. 3 is a cross sectional view of the pillow 10 and it illustrates the relative positions of the bladder 18, the center foam section 24, the filler foam support 22 and the convoluted edge 16 of the shell 12.

FIG. 4 is a side cross sectional view of the pillow along line 4—4 as shown in FIG. 3; it illustrates the outer shell 12, the convoluted edge 16, the rear of the bladder 18, the center foam section 24, and the filler foam section 22.

The pillow herein described provides support for the head and neck of the user. The adjustable support which it provides serves to relieve pressure on the neck and thus aids the healing process while simultaneously providing needed comfort.

Size is not critical and, therefore, the pillow may be standard, queen, or king size or any other desired dimension. In addition, other smaller pillows can be made by simply adjusting the size of the shell and bladder and the amount of foam stuffing employed. And although the support pillow of this invention has been described by reference to its use in supporting the neck or head of a user, it can also be employed to support or elevate other areas as, for example, a knee, ankle, or other body part.

This invention has been described by references to various embodiments of the invention as shown in the Drawings, but various changes can be made to the type of material employed and to the relative positions of the elements which comprise this concept without departing from the spirit or scope of this invention. The invention is limited only by the scope of the appended claims.

What is claimed is:

1. A support pillow having a shell enclosure and an interior cavity which contains an inflatable "U" shaped bladder wherein the area within the "U" includes support comprised of foam material, wherein the area outside the "U" includes support comprised of foam material, and wherein said bladder includes a valve means extending through the shell enclosure so as to allow a user to control the amount of inflation of said bladder.

2. A support pillow according to claim 1 wherein the valve means includes a gas line and a pivotable cap that fits into and seals said gas line.

3. A support pillow according to claim 1 wherein the valve means includes a bulb-type inflation means.

4. A support pillow according to claim 1 wherein the valve means is a bleed-type valve.

5. A support pillow according to claim 1 wherein the shell enclosure includes a reticulated pattern of openings therethrough.

6. A support pillow according to claim 1 wherein the inside edge of said shell possesses a convoluted edge.

* * * * *